US006364178B1

(12) United States Patent
Paczonay

(10) Patent No.: US 6,364,178 B1
(45) Date of Patent: Apr. 2, 2002

(54) FLUID CONTROL AND DISPENSER APPARATUS

(76) Inventor: Joseph R. Paczonay, P. O. Box 1494, Campbell, CA (US) 95009

( * ) Notice: Subject to any disclaimer, the term of this patent is extended or adjusted under 35 U.S.C. 154(b) by 0 days.

(21) Appl. No.: 09/614,058

(22) Filed: Jul. 11, 2000

(51) Int. Cl.[7] ..... B67D 3/00
(52) U.S. Cl. ..... 222/522; 222/484
(58) Field of Search ..... 222/522, 532, 222/537, 481.5, 484, 483

(56) References Cited

U.S. PATENT DOCUMENTS

| | | | | |
|---|---|---|---|---|
| 1,296,341 A | | 3/1919 | Towle | |
| 2,790,582 A | * | 4/1957 | Halpern | 222/484 |
| 2,919,057 A | * | 12/1959 | Halpern | 222/484 |
| 3,430,824 A | | 3/1969 | Conners et al. | |
| 3,493,146 A | | 2/1970 | Conners et al. | |
| 4,331,266 A | | 5/1982 | Bond | |
| 4,340,157 A | | 7/1982 | Darner | |
| 4,351,455 A | | 9/1982 | Bond | |
| 4,420,101 A | | 12/1983 | O'Neill | |
| 4,478,242 A | | 10/1984 | Bond | |
| 4,506,809 A | | 3/1985 | Corsette | |
| 4,513,891 A | | 4/1985 | Hain et al. | |
| 4,807,785 A | * | 2/1989 | Pritchett | 222/484 |
| 4,852,781 A | | 8/1989 | Shurnick et al. | |
| 5,033,655 A | | 7/1991 | Brown | |
| 5,215,231 A | | 6/1993 | Paczonay | |
| 5,472,122 A | | 12/1995 | Appleby | |
| 5,927,565 A | | 7/1999 | Paczonay | |

* cited by examiner

*Primary Examiner*—Philippe Derakshani
(74) *Attorney, Agent, or Firm*—Thomas R. Lampe

(57) ABSTRACT

A fluid control and dispenser apparatus includes a dispenser member having an inlet, a fluid ingress opening and a fluid egress opening. A flexible valve member is located in the dispenser member and movable between a first position in which the valve member closes the fluid ingress opening and a second position in which the flexible valve member opens the fluid ingress opening. The flexible valve member is positioned between the fluid ingress opening and the fluid egress opening for directing venting fluid passing through the fluid ingress opening during dispensing away from the egress opening.

28 Claims, 19 Drawing Sheets

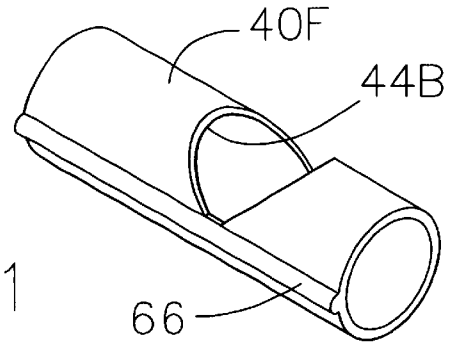
Fig. 11
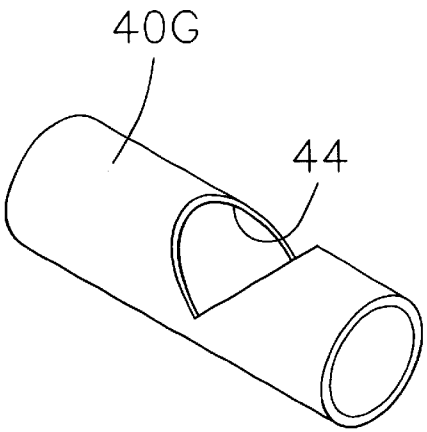
Fig. 12
Fig. 9
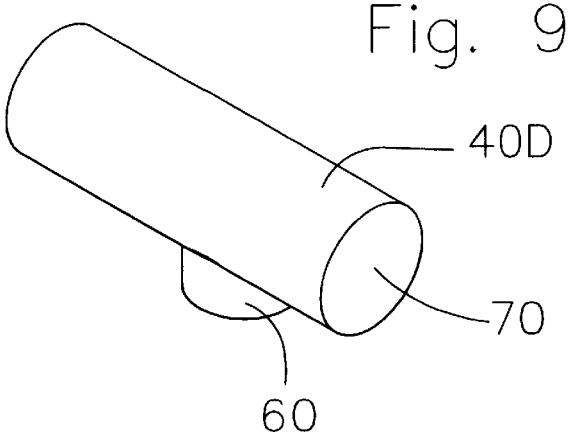
Fig. 10
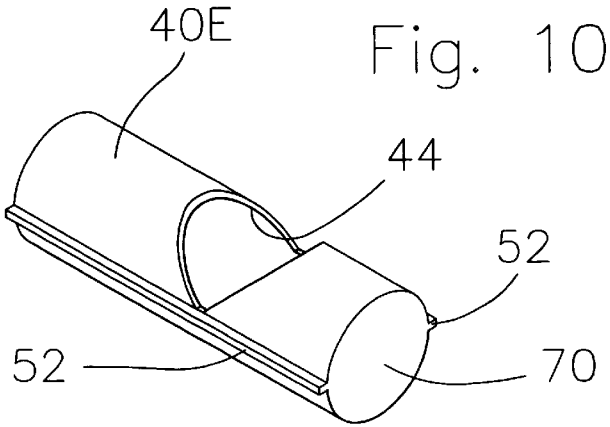

FLUID CONTROL AND DISPENSER APPARATUS

TECHNICAL FIELD

This invention relates to fluid control and dispenser apparatus. The invention has particular application to the dispensing of liquid from a container, for example, a plastic jug or bottle. The principles of the invention, however, are applicable to the dispensing of fluids generally.

BACKGROUND OF THE INVENTION

It is well known to incorporate dispensing spigots, spouts and the like on liquid containers, for example the widely employed jugs or bottles formed of plastic sheet material.

To promote the efficient dispensing of liquid from such containers a vent allowing the ingress of ambient air into the container is required. Such vent is of course for the purpose of introducing air into the container interior to replace the liquid being dispensed therefrom.

A common practice with such plastic containers has been to punch a hole therein to form a vent. However, this is not wholly satisfactory since leakage can result and the container itself cannot be reused. This is wasteful and environmentally unsound.

Of course, a number of approaches more sophisticated than punching a vent hole into a container have been employed in order to allow air into a container while fluid is exiting therefrom.

U.S. Pat. No. 4,340,157, issued Jul. 20, 1982, for example, discloses a dispenser cap with a dual valve arrangement to allow air into the dispenser through one valve and fluid to exit through another valve. However, the exiting fluid and the inlet air both use the same passageway for egress or ingress. With this arrangement continuous flow of fluid cannot occur. Also, the container must be in an upright position and it must be deformed to allow fluid flow.

U.S. Pat. No. 4,420,101, issued Dec. 13, 1983, discloses a dispenser cap with a dispensing opening that allows fluid to exit the container and air to enter the container through the same passage. With this arrangement continuous fluid flow is prevented.

U.S. Pat. No. 4,506,809, issued Mar. 26, 1985, discloses a dispensing cap with a preloaded annular valve member that acts to allow air back into the container through the same passageway that fluid exits the container. With this arrangement continuous flow of fluid is prohibited.

U.S. Pat. No. 4,513,891, issued Apr. 30, 1985, discloses a container with a spray nozzle arrangement. The air inlet shown in this patent may possibly leak because the fluid pressure against the check valve diaphragm of the apparatus is not concentrated around the air inlet holes when pressure is applied to the spray bottle.

U.S. Pat. No. 4,852,781, issued Aug. 1, 1989, discloses a fluid delivery system with an air ingress passageway that is separate from the fluid exit passageway. To allow fluid flow with this patent, the container must be in an upright position. Also, the fluid can exit through the air inlet passageway if the container is inverted. The L-shaped air passageway employed is difficult to manufacture.

U.S. Pat. No. 5,215,231, issued Jun. 1, 1993, discloses a bottle with a special exit port that closes when pulled out, preventing fluid flow, and opens when pushed in, allowing fluid flow. An air inlet check valve is provided adjacent to the fluid exit port. The container must be inverted to operate and if the air inlet valve leaks, it will leak in an undesirable location. Furthermore, the cap and bottle are designed to interact with a special bottle cage that will prevent any debris from entering into the air relief valve or the exit port.

U.S. Pat. No. 5,472,122, issued Dec. 5, 1995, discloses a container cap with an air inlet valve arrangement. The air inlet valves shown do not provide for any means to prevent incoming air from being entrained back into the exiting fluid stream.

The following patents disclose various types of dispensers employed to dispense liquid from plastic containers or the like and are believed to be further representative of the general state of the art in this field: U.S. Pat. No. 3,493,146, issued Feb. 3, 1970 U.S. Pat. No. 4,331,266, issued May 25, 1982, U.S. Pat. No. 4,478,242, issued Oct. 23, 1984, U.S. Pat. No. 5,927,565, issued Jul. 27, 1999, U.S. Pat. No. 4,351,455, issued Sep. 28, 1982, U.S. Pat. No. 3,430,824, issued Mar. 4, 1969, U.S. Pat. No. 1,296,341, issued Mar. 4, 1919 and U.S. Pat. No. 5,033,655, issued Jul. 23, 1991.

The devices shown in the above-identified patents provide no teaching or suggestion of the combination of structural elements disclosed and claimed herein or their cooperative relationship.

DISCLOSURE OF INVENTION

The present invention relates to fluid control and dispenser apparatus which provides for the simultaneous dispensing of a fluid and the replenishment of the fluid by ambient air or some other fluid to promote dispensing.

The invention is characterized by its relative simplicity, low cost, and ease and reliability of use. When employing the apparatus, no vent holes need be punched into a container with which the apparatus is associated.

The apparatus includes a dispenser member, the dispenser member defining a dispenser member interior, a fluid inlet, a fluid ingress opening and a fluid egress opening. The fluid inlet, the fluid ingress opening and the fluid egress opening are all spaced from one another and communicate with the dispenser member interior.

A flexible valve member is located in the dispenser member interior adjacent to the fluid ingress opening and is movable between a first position wherein the flexible valve member closes the fluid ingress opening and a second position wherein the flexible valve member is spaced from the fluid ingress opening, opens the fluid ingress opening and allows passage of fluid through the fluid ingress opening into the dispenser member interior. The flexible valve member is positioned between the fluid ingress opening and the fluid egress opening when spaced from the fluid ingress opening for directing fluid passing through the fluid ingress opening into the dispenser member interior away from the fluid egress opening and in the direction of the fluid inlet.

Other features, advantages, and objects of the present invention will become apparent with reference to the following description and accompanying drawings.

BRIEF DESCRIPTION OF DRAWINGS

FIGS. 9, 10, 11 and 12 are perspective views of four additional embodiments of the flexible valve member;

MODES FOR CARRYING OUT THE INVENTION

Figure 1:
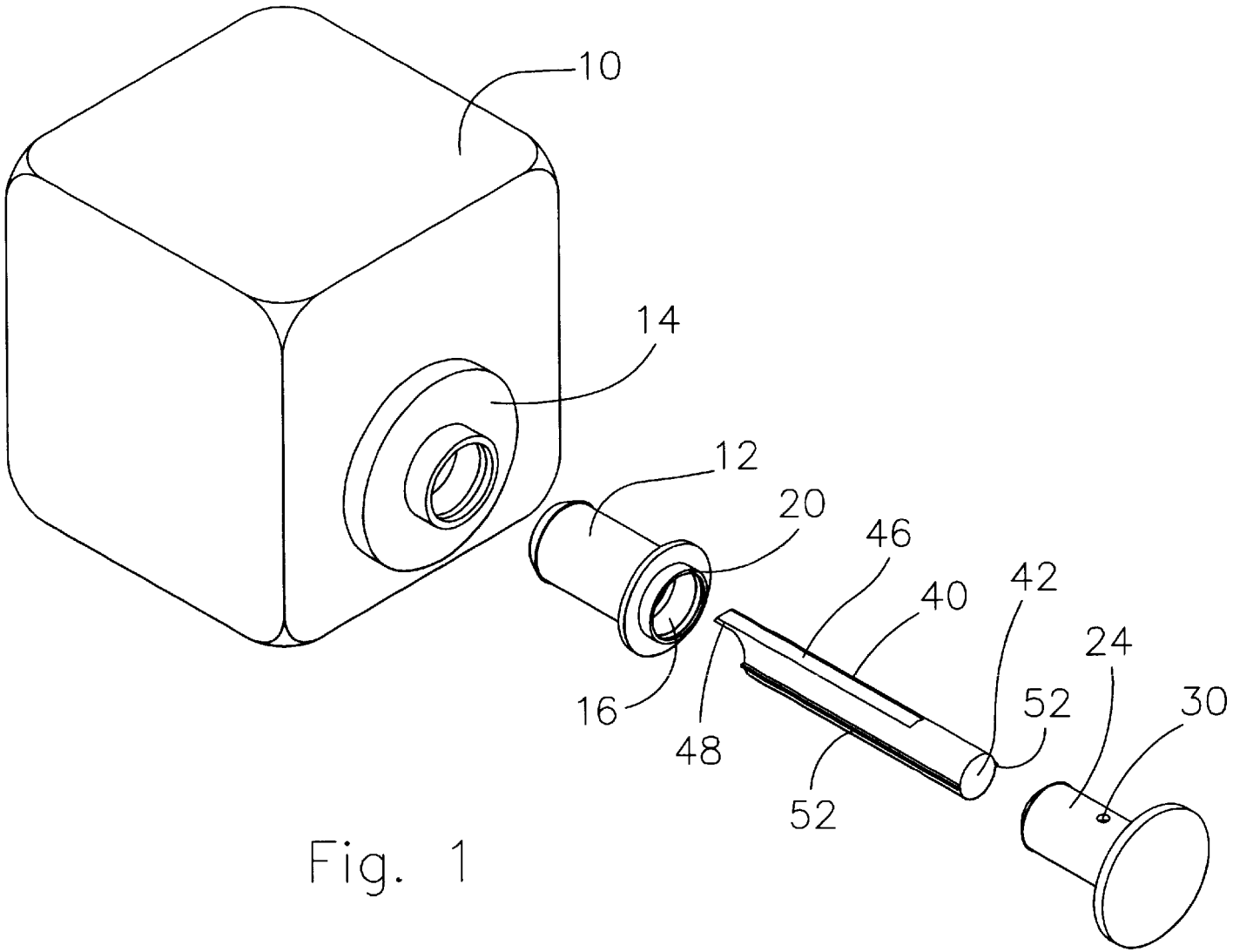
FIG. 1 is a frontal, perspective, exploded view illustrating a liquid container and structural elements of apparatus constructed in accordance with the teachings of the present invention associated with the container.

Referring now to FIGS. 1–4, a container 10 of conventional construction is illustrated, the container, for purposes of illustration, being blow molded of plastic sheet material and being of a size (for example, 2.5 gallon) commonly employed to contain liquid such as water, milk, juice, and so forth.

As will be seen below, the apparatus of the present invention, in the form illustrated, is in the nature of a spigot utilized to dispense the liquid contents of the container. It has been common practice to punch or cut a vent hole in containers of this type to promote proper flow of liquid from the container through spigots. Utilizing the teachings of the present invention no such vent hole need be placed in the container, allowing the container to be reused or stored.

The apparatus of the present invention includes a support 12 in the nature of a cylinder located within structure 14 affixed to the container 10. The support 12 may be fixedly attached to structure 14 or may be slidably mounted relative thereto, both being known per se in the prior art. The support 12 defines a support interior 16, a support inlet opening 18 and a support outlet opening 20. The support inlet opening and the support outlet opening are spaced from one another and communicate with the support interior.

Located within the support interior 16 is a dispenser member 24. The dispenser member defines a dispenser member interior 26, a fluid inlet 28, a fluid ingress opening 30 and a fluid egress opening 32. The fluid inlet, the fluid ingress opening and the fluid egress opening are all spaced from one another and communicate with the dispenser member interior 26.

Figure 2:
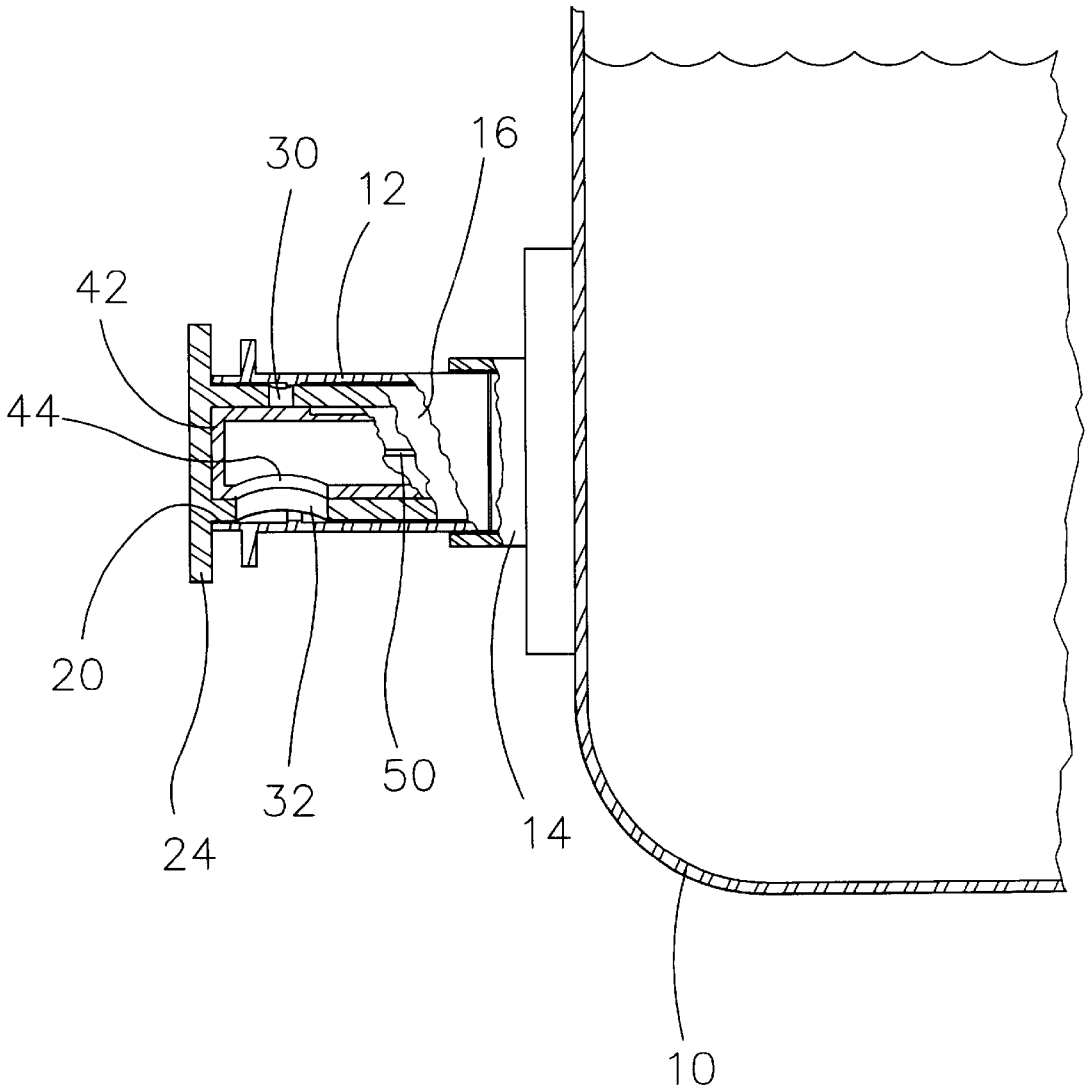
FIG. 2 is an enlarged, partial, sectional side view illustrating the apparatus attached to a container portion with the structural elements of the apparatus in the relative positions assumed thereby when dispensing is not taking place.
Figure 3A:
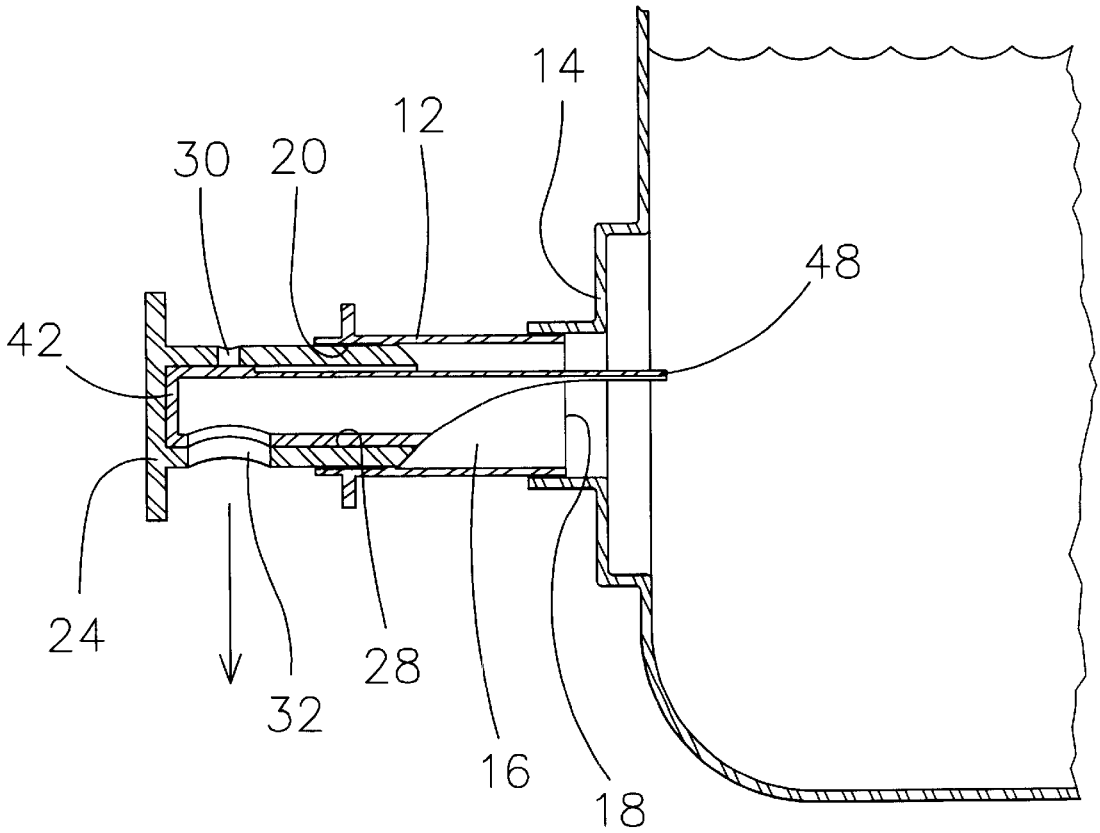
FIGS. 3A and 3B are views similar to FIG. 2, slightly reduced in size, illustrating the relative positions assumed by the apparatus structural elements during dispensing.
Figure 3B:
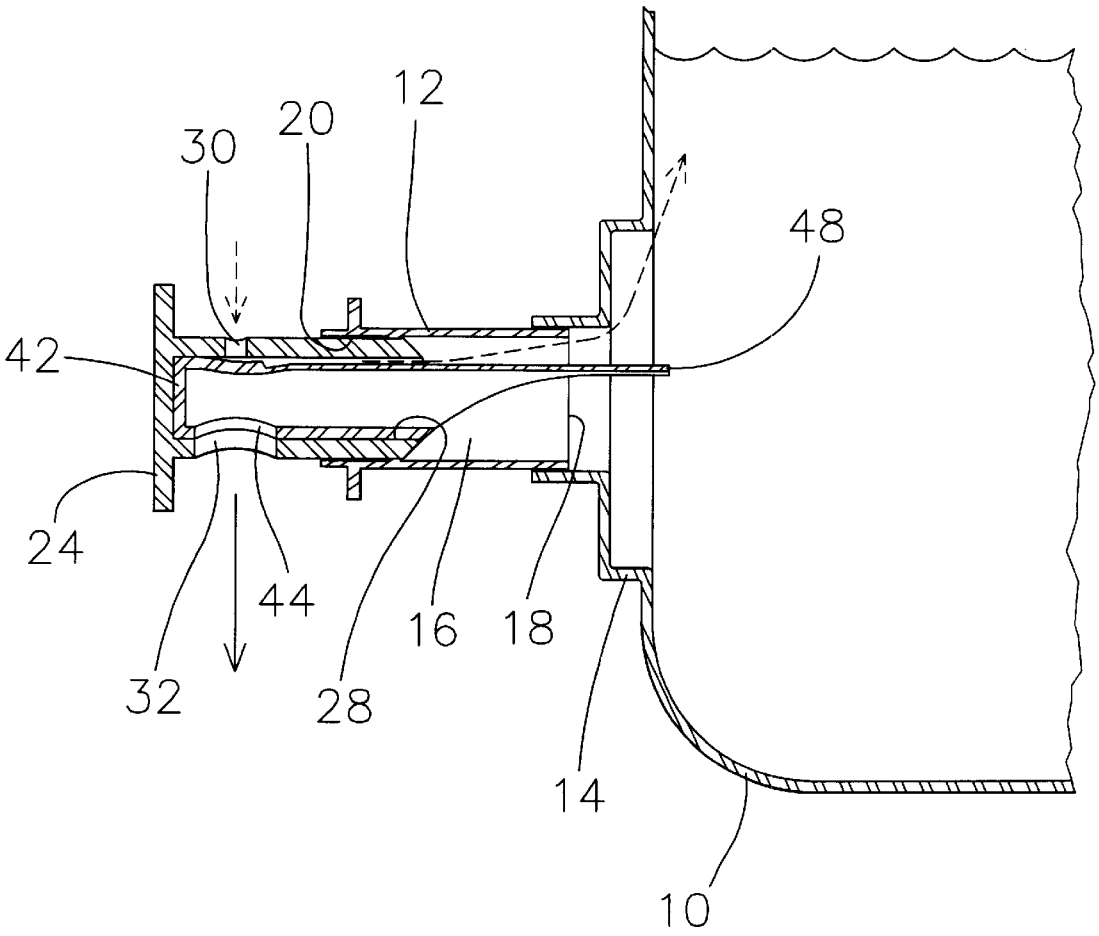

The dispenser member 24 may be manually slid relative to the structure 14 and the support 12 between the positions shown in FIG. 2 and FIGS. 3A and 3B. When the dispenser member is in the position shown in FIGS. 3A and 3B, liquid from container 10 is free to flow downwardly from fluid egress opening 32 as indicated by the solid arrow in those figures. When, however, the dispenser member 24 is in the position shown in FIG. 2, the opening 32 is closed by support 12 and fluid will not be dispensed.

Located in the dispenser member interior 26 is a flexible valve member 40 formed of rubber, silicone, plastic or other suitable flexible material. By moving the dispenser member 24 from the non-dispensing position (shown in FIG. 2) to the dispensing position (shown in FIGS. 3A and 3B), fluid from the container can exit through the dispenser member via the fluid egress opening 32. As the fluid exits the container, a vacuum is formed in said container. The vacuum causes the valve member 40 to move from the non-venting position (FIG. 3A) to the venting position (FIG. 3B). The valve member 40 is positioned adjacent to the fluid ingress opening 30. When in its non-venting position the valve member closes the fluid ingress opening (the position shown in FIG. 3A, for example) and when it is in its venting position (the position shown in FIG. 3B, for example) the valve member is spaced from the fluid ingress opening, opens the fluid ingress opening and allows passage of air through the fluid ingress opening into the dispenser member interior.

The flexible valve member 40 is positioned between the fluid ingress opening 30 and the fluid egress opening 32 for directing fluid passing through the fluid ingress opening into the dispenser member interior away from the fluid egress opening and in the direction of the fluid inlet. This is shown in FIG. 3B by the dash arrow lines. This air replaces the liquid being dispensed and promotes efficient dispensing.

The flexible valve member 40 is in the nature of a sleeve and is tubular along a portion of the length thereof. In this embodiment the valve member 40 has a closed end 42. The flexible valve member at the tubular portion thereof adjoining closed end 42 defines a valve member opening 44 communicating with fluid egress opening 32.

For the most part, the outer peripheral surface of flexible valve member 40 is in contact with and conforms to the shape of the inner cylindrical wall of dispenser member 24. However, in the disclosed embodiment the valve member is flattened as designated by reference numeral 46 to form a flat fluid engagement surface and provide a more open fluid-flow passageway leading to the inner or distal end of the valve member. The inner or distal end 48 of the flexible valve member extends through support inlet opening 18 and into the interior of container 10. This ensures virtually no intermingling between the venting air and the liquid being dispensed through the apparatus. The fluid ingress opening 30 and fluid egress opening 32 of the dispenser member 24 are in alignment.

Figure 4:
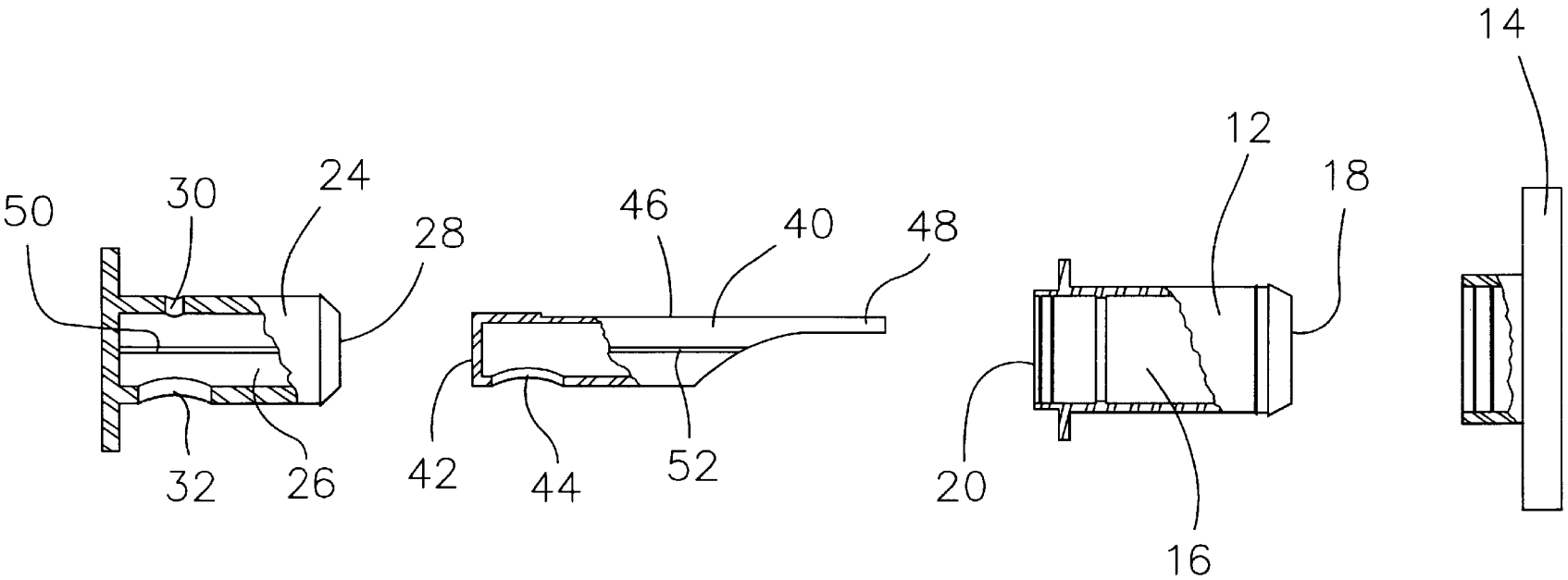
FIG. 4 is an exploded, side view in partial cross-section of the structural elements of the apparatus.
Figure 5:
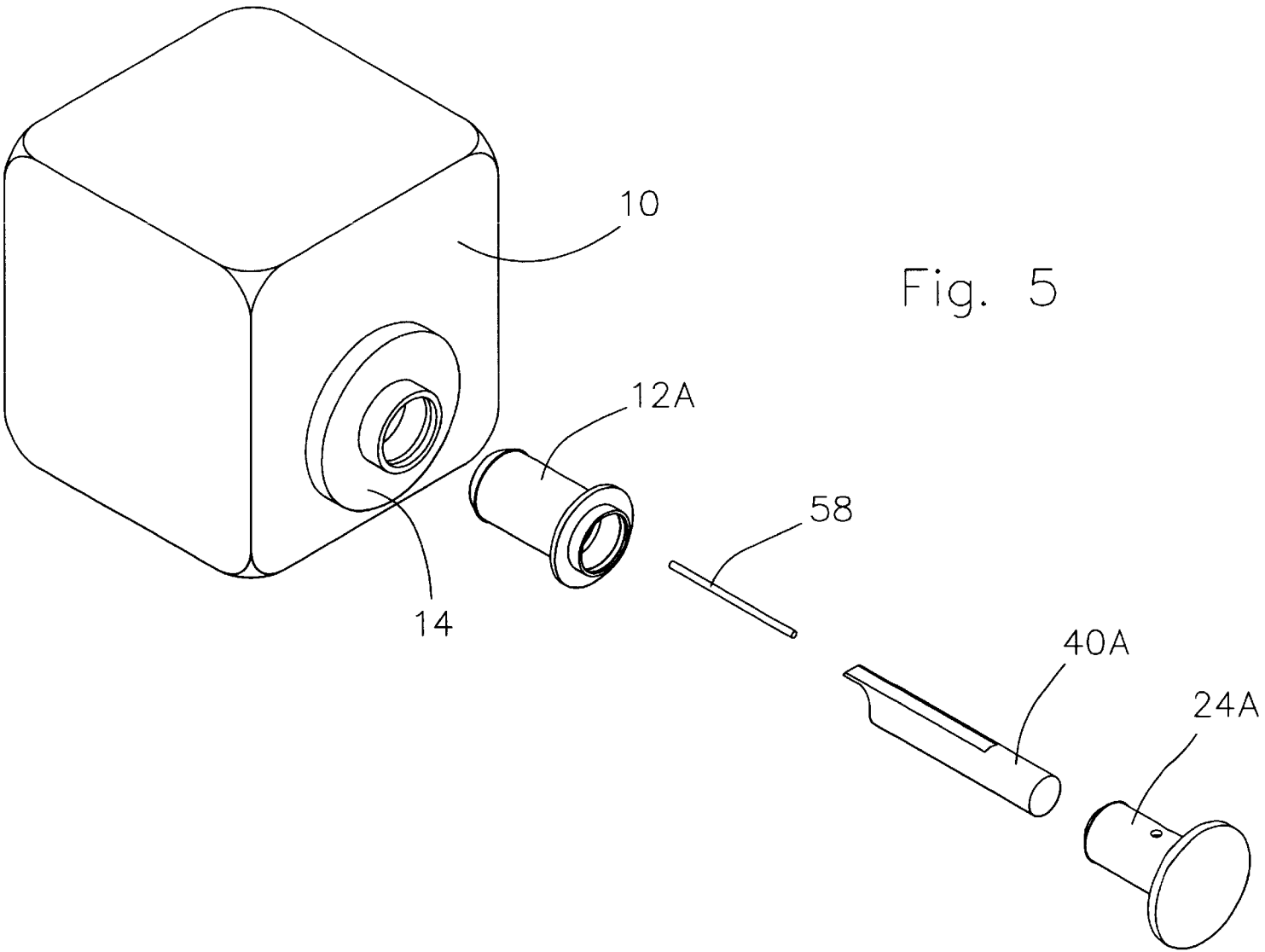
FIG. 5 is a view similar to FIG. 1 but illustrating an alternative embodiment of the apparatus.

It is important that a fluid-tight seal be formed between the flexible valve member and the dispenser member in the area surrounding the fluid ingress opening. In this regard dispenser member 24 has two elongated grooves 50 formed at opposed sides thereof about midway between the fluid ingress opening and the fluid egress opening. One such groove is illustrated in FIG. 2 and FIG. 4, although it is to be understood that a groove of like configuration is on the other side, the side not visible in those figures.

Elongated ribs 52 are integrally formed at the sides of the main body of flexible valve member 40 which are insertable into grooves 50. Preferably, the protruding dimensions of each rib exceeds the depth dimension of each groove whereby each rib urges the valve member to make intimate contact with the interior surface of the dispenser member. This ensures the formation of a fluid-tight seal between the dispenser member and the flexible valve member in the area between each rib of the flexible valve member. Furthermore, the ribs and grooves cooperate to properly align the valve member opening 44 with the egress opening 32 and also provide a means of connecting the dispenser member and the flexible valve member to retain them in position after they are assembled.

Figure 6B:
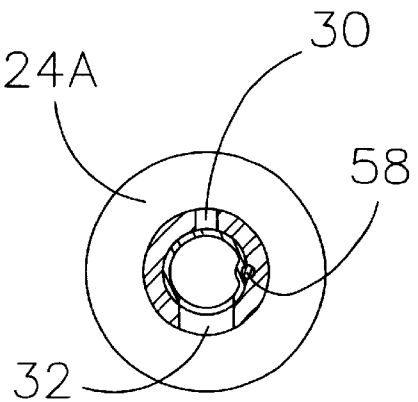
FIG. 6B is a sectional view taken along the line 6B—6B of FIG. 6A.
Figure 6C:
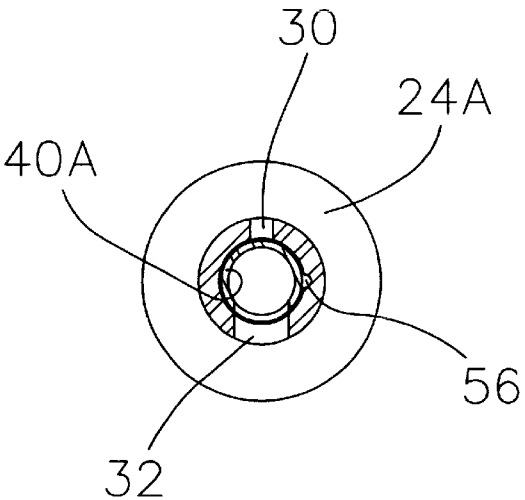
FIG. 6C is a view similar to FIG. 6B but with one of the structural elements shown in 6B not in place or illustrated.
Figure 6A:
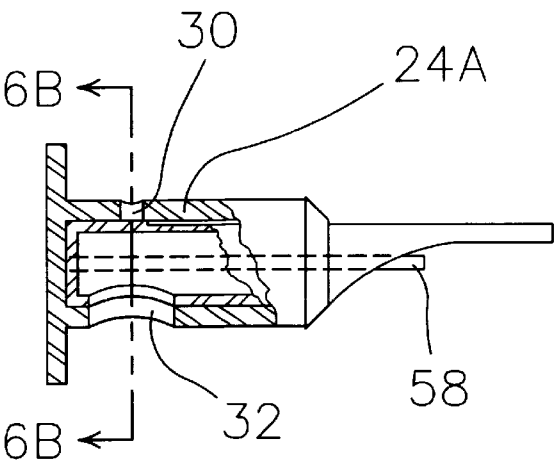
FIG. 6A is an enlarged, partial, sectional, side view of structural components of the embodiment of FIG. 5.

FIGS. 5 and 6A–6C disclose another embodiment of the invention. In this version a single groove 56 is formed in one side of the dispenser member 24A in the interior thereof. This is shown in FIG. 6C. FIGS. 6A and 6B illustrate an elongated member in the form of a pin or shaft 58 positioned in the groove 56. The diameter of the elongated member is somewhat larger than the depth dimension of the groove so that a portion of the elongated member projects toward the flexible valve member and engages the flexible valve member. This causes the portion of the flexible valve member engaged by the pin 58 to bulge inwardly as shown in FIG. 6B. In turn, this increases the outwardly directed forces applied by the flexible valve member elsewhere in the dispenser member, including at fluid ingress opening 30 and the portions of the flexible valve member engaging the inner cylindrical surface of the dispenser member around fluid egress opening 32 to increase the seal.

Figure 7B:
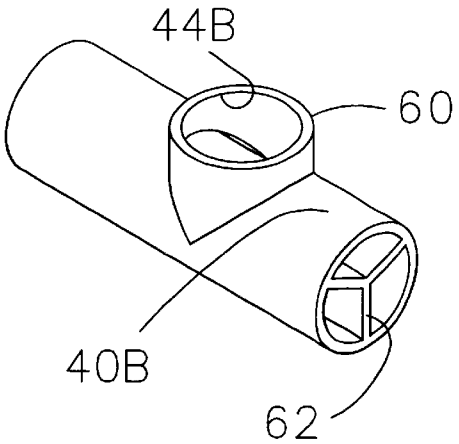
FIGS. 7A and 7B are, respectively, enlarged, top perspective views and bottom perspective views of an alternative form of flexible valve member employed in the invention.
Figure 7A:
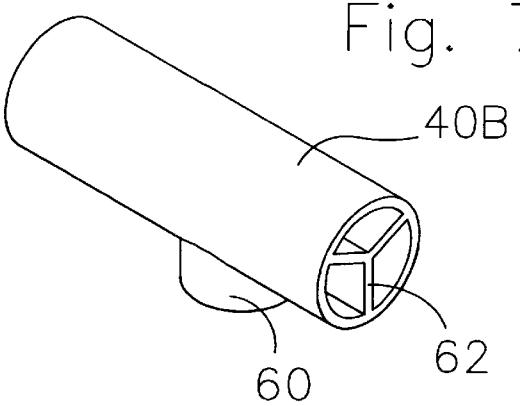

FIGS. 7A and 7B illustrate an embodiment of the flexible valve member designated by reference numeral 40B. In this arrangement the valve member opening 44B is disposed at the end of a cylindrically-shaped boss or stub 60 projecting from the main part of the flexible valve member. This stub 60 acts to align the valve member opening with the fluid egress opening. In addition, the flexible valve member 40B is open ended at both ends thereof and has a rib member 62 passing completely through the interior of the flexible valve member. The rib member 62 comprises a strengthening element which is employed to resist collapse of the tubular-shaped flexible valve member main body or sleeve.

Figure 8B:
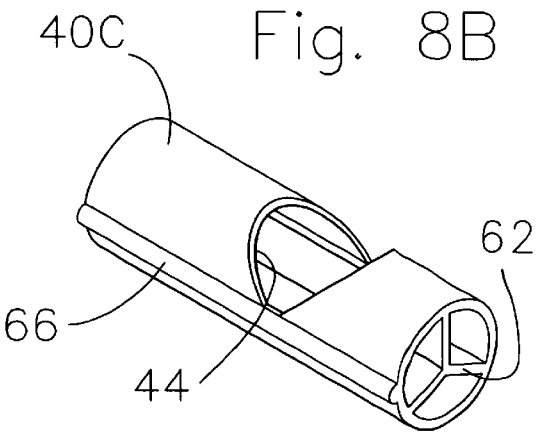
FIGS. 8A and 8B are views similar to FIGS. 7A and 7B but illustrating a different embodiment of the flexible valve member.
Figure 8A:
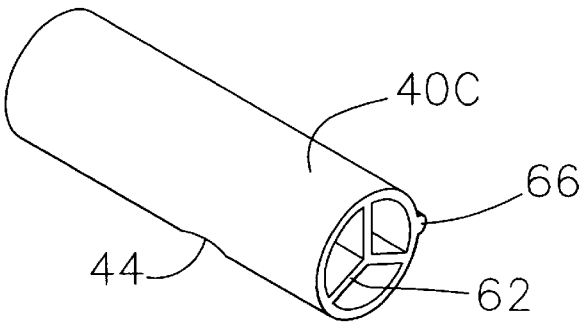
Figure 13:
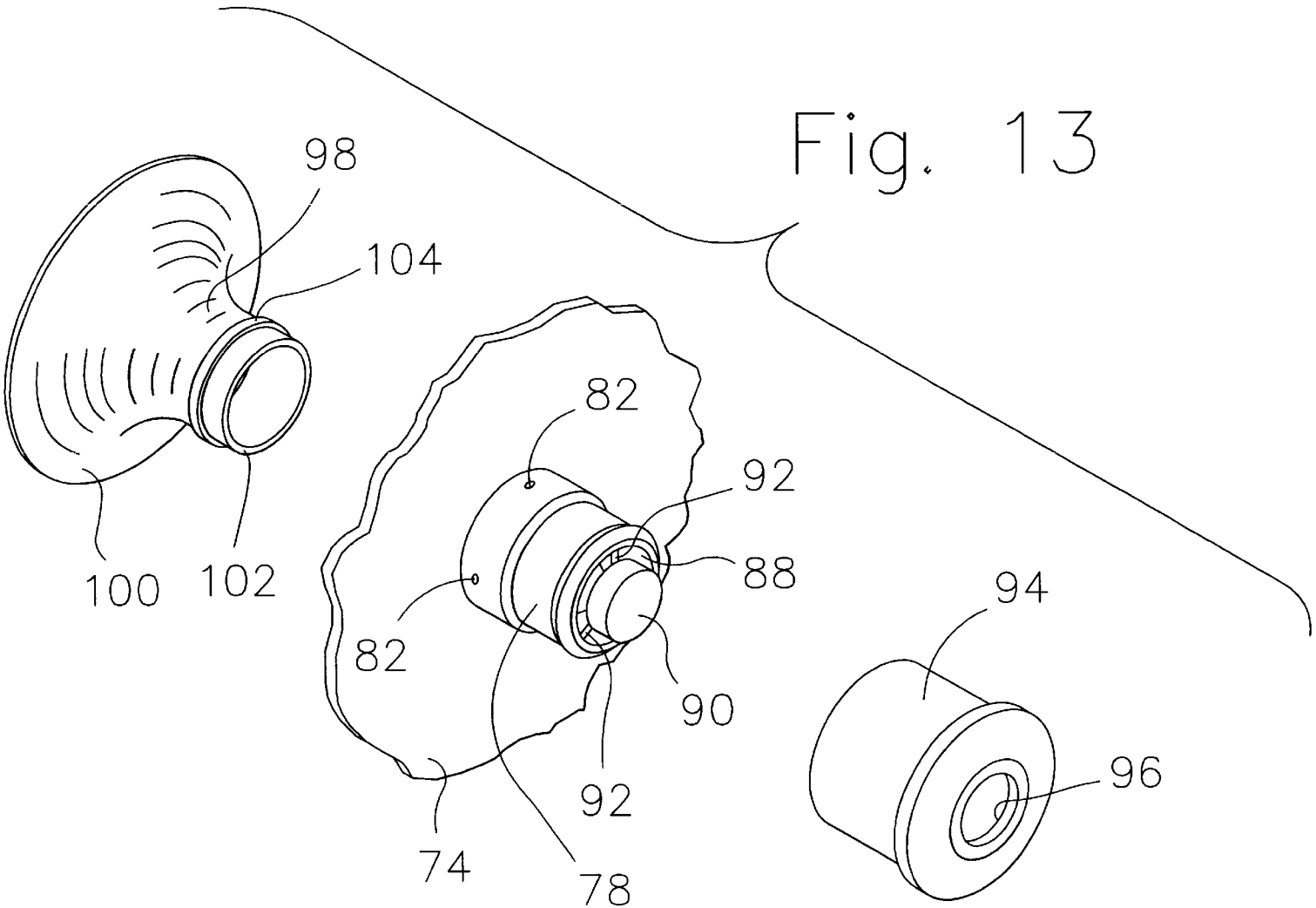
FIG. 13 is an exploded, perspective view of yet another form of apparatus constructed in accordance with the teachings of the present invention.
Figure 14:
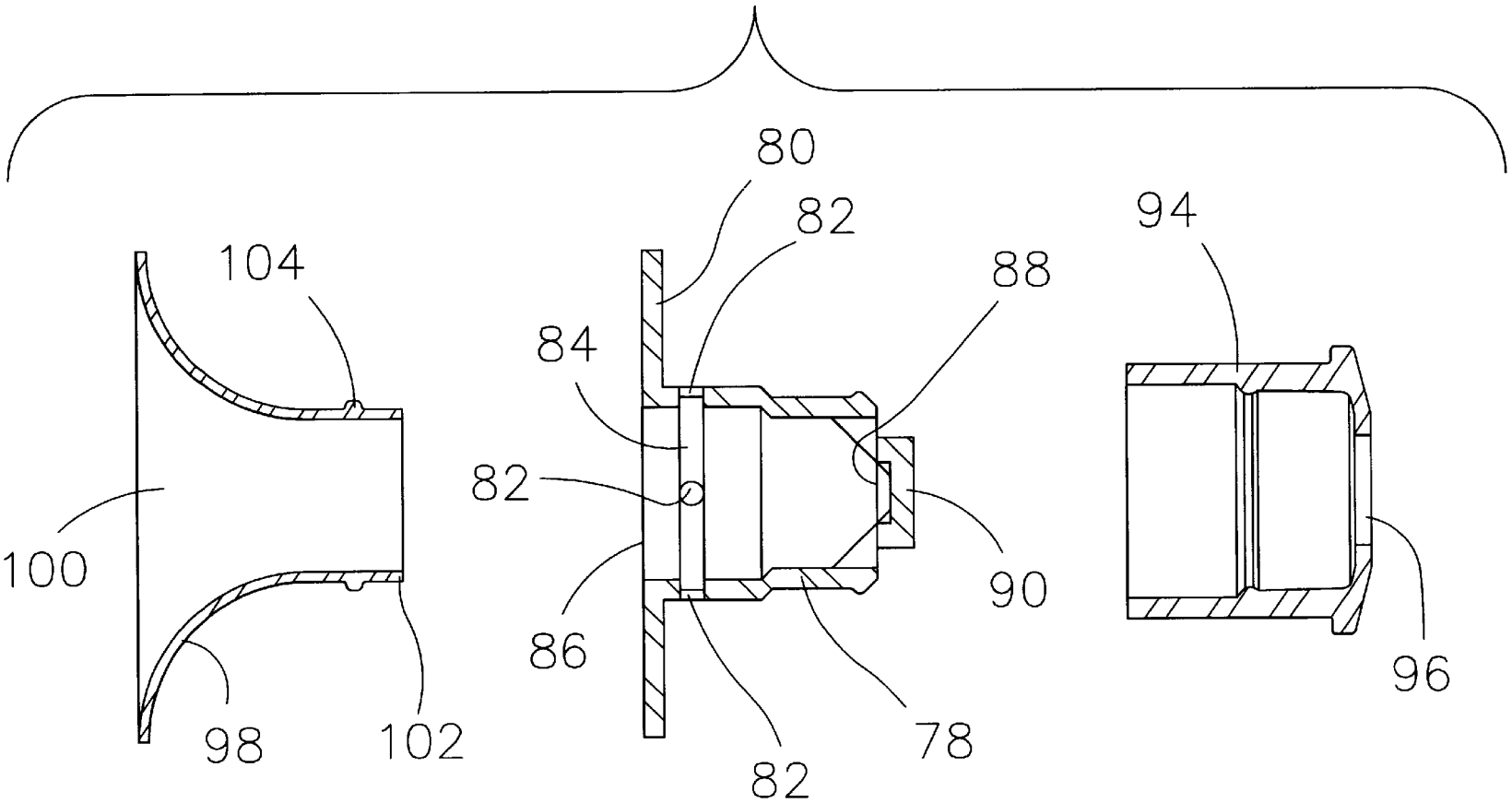
FIG. 14 is a cross-sectional, exploded side view of the structural elements of FIG. 13.

FIGS. 8A and 8B illustrate yet another version of the flexible valve member, valve member 40C. This version of the flexible valve member does not have a cylindrically-shaped stub, but rather a valve member opening 44 is formed directly in the main body of the flexible valve member. A rib member 62 is employed. A rib 66 projects from one side of the cylindrical portion of the flexible valve member 40C to cooperate with a groove in an associated dispenser member (not shown), the rib 66 projects outwardly a distance somewhat greater than the depth dimension of the groove so that a portion of the flexible valve member 40C will bulge inwardly to increase the outwardly directed forces applied by the rest of the flexible valve member to the inner surface of the dispenser member to increase seal pressure at the fluid ingress opening and around the fluid egress opening.

FIGS. 9 through 12 show other flexible valve member embodiments, all being in the form of a flexible sleeve or tube. The FIG. 9 flexible valve member 40D has a closed end 70 and a valve member opening at the end of a stub cylinder 60.

FIG. 10 illustrates flexible valve member 40E with a closed end 70 and opposed ribs 52, the valve member opening 44 being formed directly in the tubular-shaped or cylindrically-shaped body of the valve member.

FIG. 11 shows a flexible valve member 40F having two open ends and a single rib 66 of the type employed in the embodiment of FIGS. 8A, 8B. No internal rib member is employed in this embodiment.

FIG. 12 illustrates an embodiment of the flexible valve member, flexible valve member 40G, having two open ends, no ribs (internal or external), and a valve member opening 44 formed in the cylinder body.

FIGS. 13–16 illustrate yet another embodiment of the invention, this embodiment being employed at the neck of a bottle 74 which may be a bottle formed of flexible plastic or rigid material. In this embodiment the dispenser member is in the form of a nozzle 78 which has an attachment flange 80 for securing the nozzle to the container. The nozzle 78 extends directly from the top of the container and spaced fluid ingress openings 82 extend radially through a side wall of the nozzle. The fluid ingress openings or vent holes are located in a circular groove 84 formed in the dispenser member or nozzle. The nozzle 78 has a fluid inlet 86 and a fluid egress opening 88. A plug 90 is located within the confines of fluid egress opening 88, being supported by radially extending connector arms 92.

Figure 15:
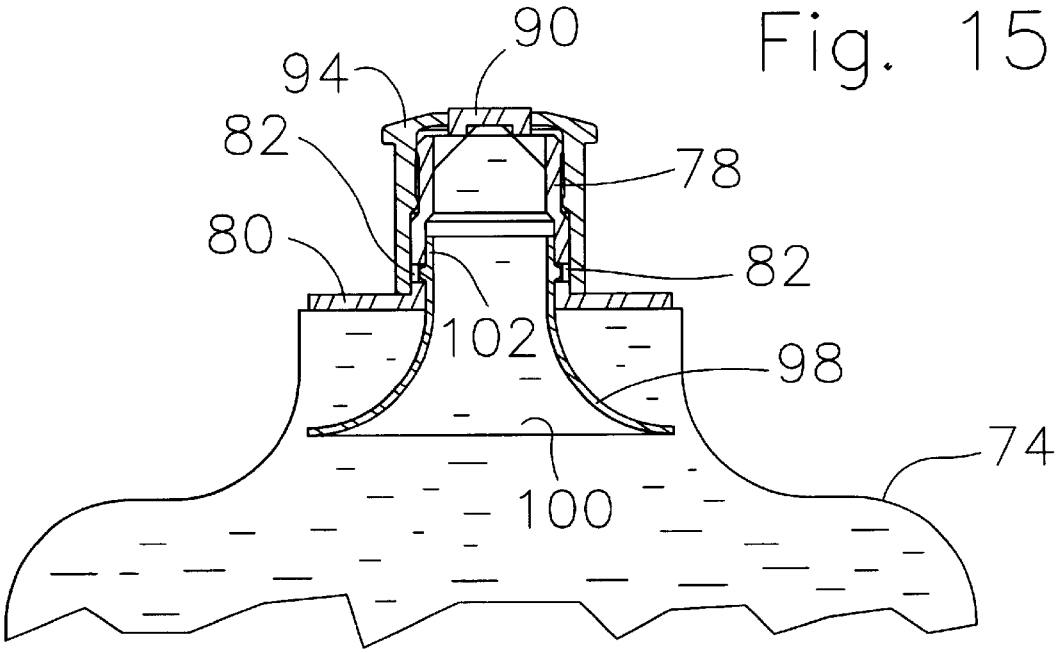
FIG. 15 illustrates the apparatus of FIG. 13 in position on a container in the form of a bottle containing liquid and showing the relative positions assumed by the structural elements thereof when dispensing is not taking place.
Figure 16:
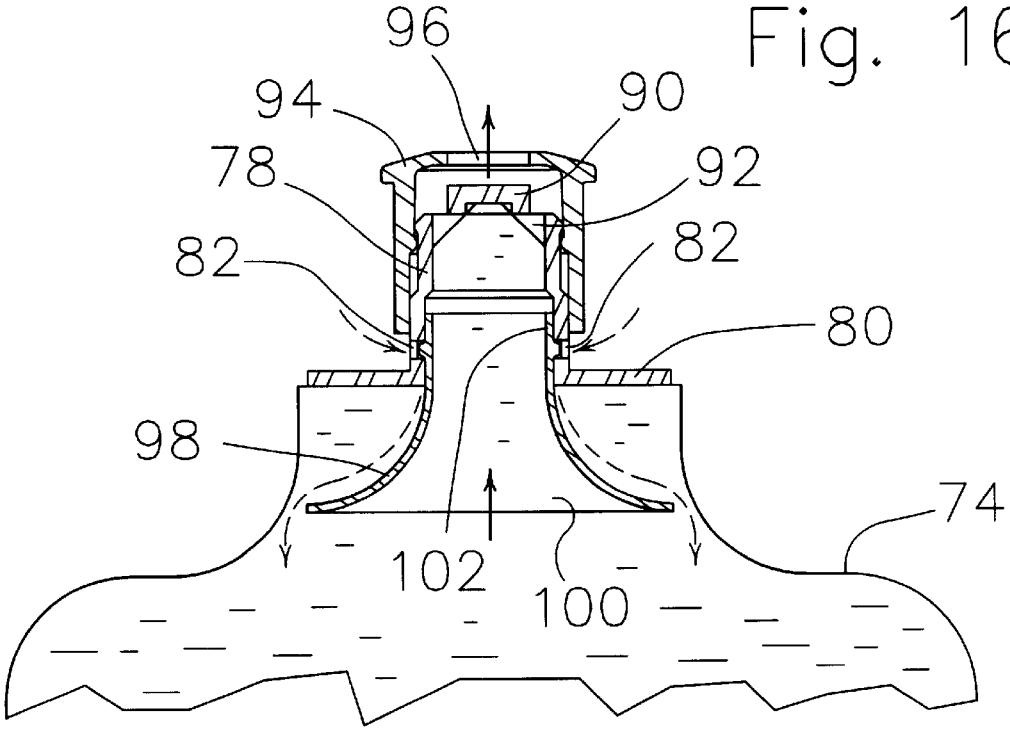
FIG. 16 is a view similar to FIG. 15 but illustrating the cooperative relationship that exists between the structural elements of the embodiment of FIG. 13 when dispensing is taking place.

A cap 94 having a round opening 96 is slidably movable relative to nozzle 78 between the two positions shown in FIGS. 15 and 16. When the cap is in the position shown in FIG. 15 the plug 90 fits in opening 96 and forms a seal. At the same time the bottom of the cap is seated against flange 80 and covers fluid ingress openings 82.

When the cap is in the position shown in FIG. 16 liquid can be dispensed through the nozzle and out through opening 96 of the cap.

In this embodiment the flexible valve member is in the form of a skirt or sleeve 98 which has a distal end 100 extending radially outwardly. The other or reduced sized end of the sleeve, end 102, has a circular detent or radially projecting rib or flange 104 formed thereon which is located in groove 84 of the nozzle. This serves to hold the flexible valve member in place with the distal end of the valve member extending into the bottle or container. A liquid-tight seal is formed between the circular detent and the nozzle in the vicinity of the groove 84.

As the pressure within the container or bottle 74 starts to drop, the flexible valve member will deform or flex and the valve member will separate slightly from the nozzle in the vicinity of the fluid ingress openings 82. This will allow air to enter the container as shown by the dash line arrows in FIG. 16, the flow of the liquid from the container through the nozzle end cap being shown by the solid line arrows. Once equilibrium in pressure has been reached, the sleeve or flexible valve member will return to its normal rest position wherein the openings 82 are sealed thereby.

Figure 18:
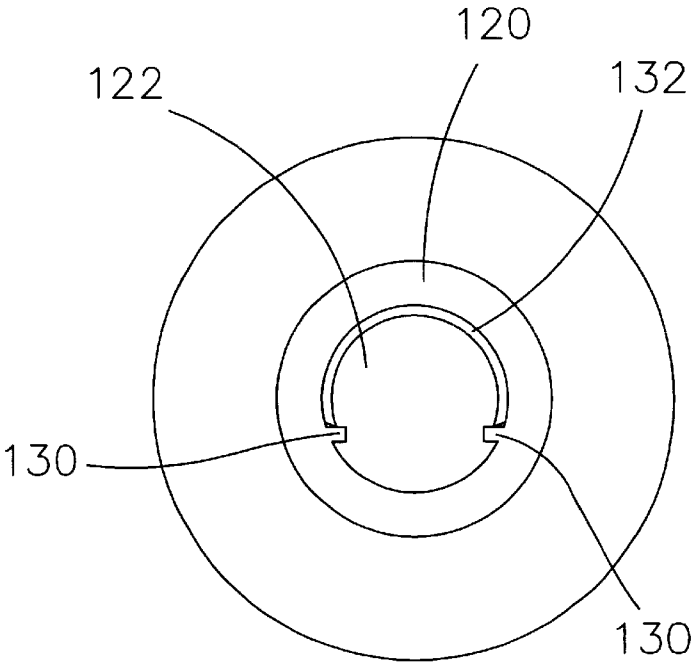
FIG. 18 is an end view of the embodiment of FIG. 17.
Figure 17:
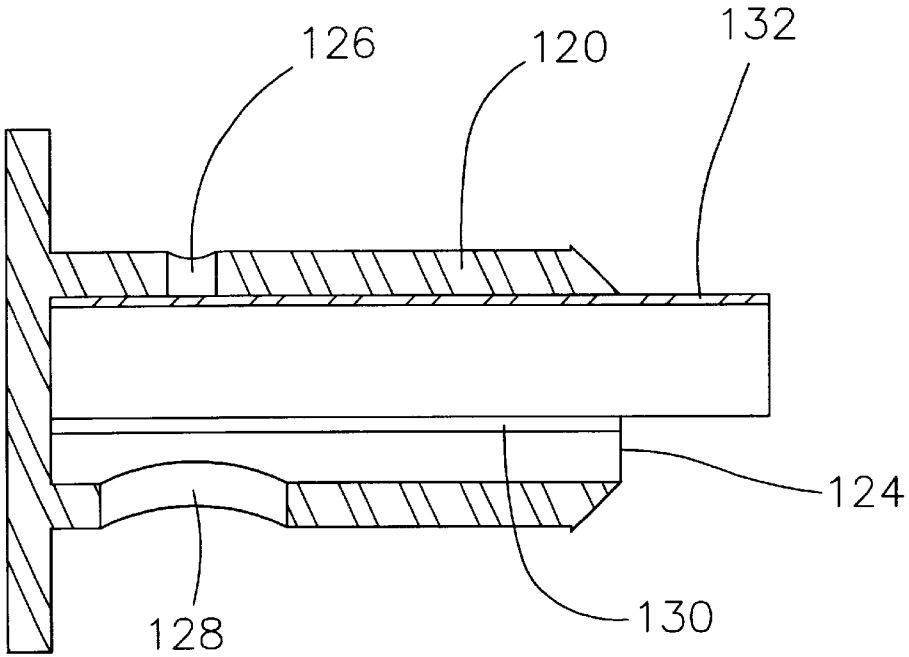
FIG. 17 is a cross-sectional side view of an alternative embodiment of the invention employing sheet material formed into a flexible valve member in a dispenser member.

FIGS. 17 and 18 illustrate an alternative form of dispenser member 120 having an interior 122, a fluid inlet 124, a fluid ingress opening 126 and a fluid egress opening 128. A pair of spaced ribs or ledges 130 project into the interior of the dispenser member.

Positioned in the dispenser member interior is a sheet 132 of precisely cut resilient material such as silicone, krayton or natural rubber. The sheet 132 comprises the flexible valve member of this embodiment of the invention. Parallel ends of the sheet rest on ledges 130 and the ledges serve to bring the outer surface of the curved sheet into engagement with the dispenser member 120 in the area of the fluid inlet 124.

The sheet 132 is bent or curved and then inserted into the dispenser member 120 with the parallel edges thereof resting on the internal ledges.

The lengths of the other edges of the resilient sheet are precisely cut to be slightly longer than the chord length between the internal ledges so that when the sheet is placed in the dispenser member the sheet is preloaded with a compressive stress. The resilient nature of the sheet causes it to conform to the internal surface of the dispenser member. This will result in a leak-tight seal between the resilient sheet and the internal surface of the dispenser member about the fluid ingress opening 126.

When fluid exits the fluid egress opening of the dispenser member, fluid or air from outside the container enters through the fluid ingress opening. In the process, the resilient sheet will momentarily buckle inwardly toward the center of the dispenser member as the vented air or other fluid passes into the container.

In the arrangement shown in FIGS. 17 and 18 the curved sheet 132 is longer than the interior of the dispenser member and projects therefrom. However, the sheet could be shorter than the length of the dispenser member interior. Other modifications may be made. For example, the ledges 130 need not be symmetrically opposed to one another.

Figure 20:
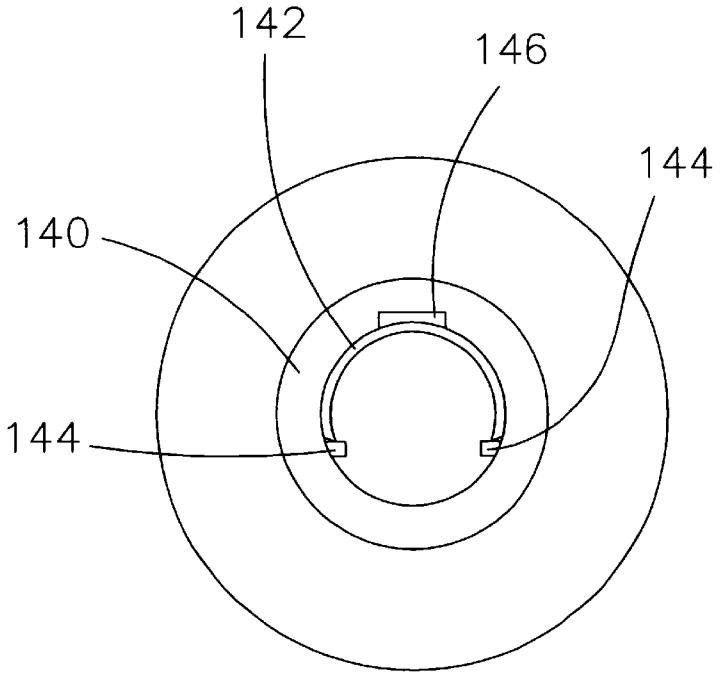
FIG. 20 is an end view of the embodiment of FIG. 19.
Figure 19:
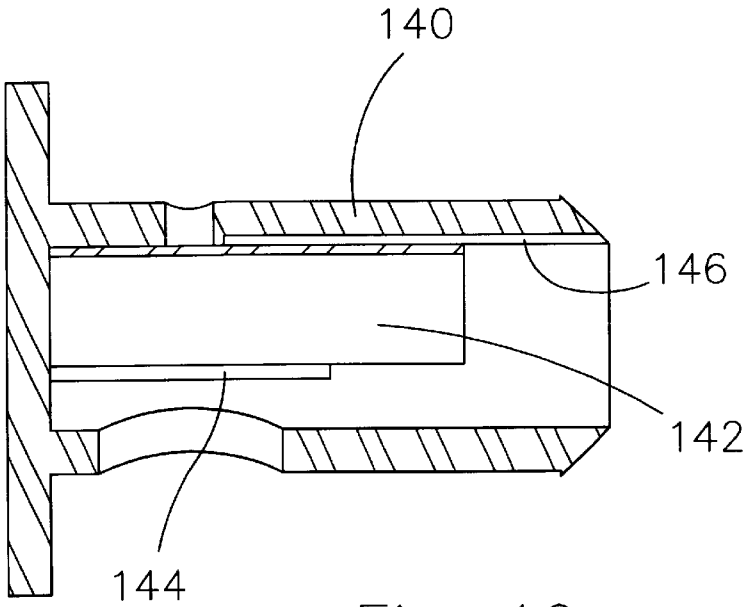
FIG. 19 is a view similar to FIG. 17 but showing a different form of dispenser member and sheet material valve member shape as compared to the FIGS. 17, 18 embodiment.

FIGS. 19 and 20 depict an embodiment of the invention wherein a dispenser member 140 has disposed therein a curved sheet functioning as a flexible valve member, sheet 142, which is shorter than the interior of the dispenser member. Likewise, the ribs or ledges 144 are shorter than those illustrated in FIGS. 17 and 18. Another difference is that a channel 146 is molded into the internal surface of the dispenser member.

Figure 22:
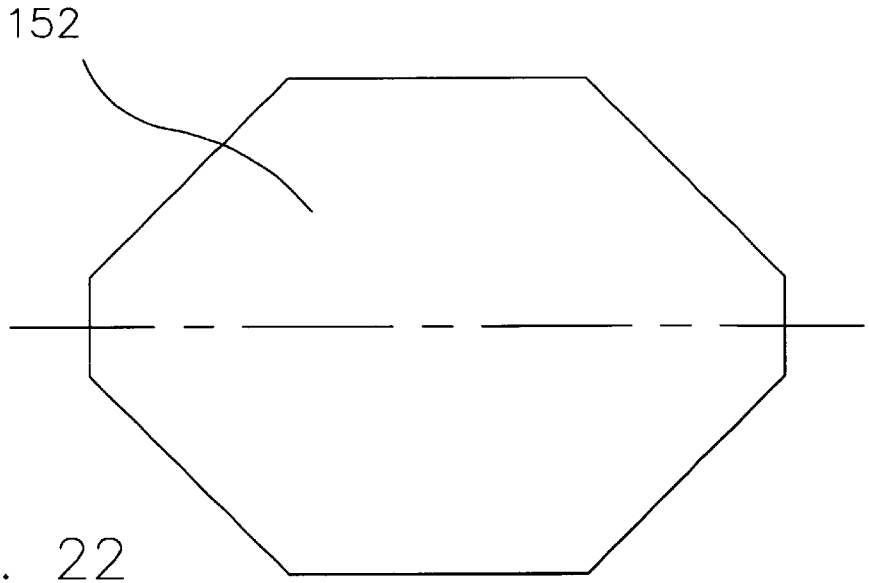
FIG. 22 shows the sheet of FIG. 21 in unrolled condition.
Figure 21:
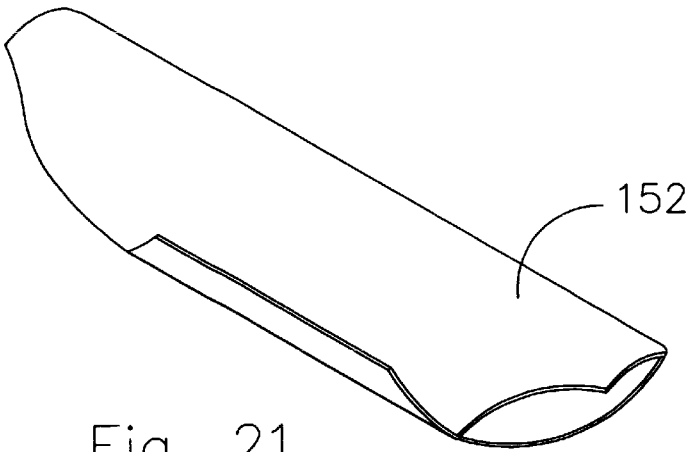
FIG. 21 is a perspective view of an alternative embodiment wherein the sheet forming the flexible valve member is rolled into a tubular configuration.
Figure 24:
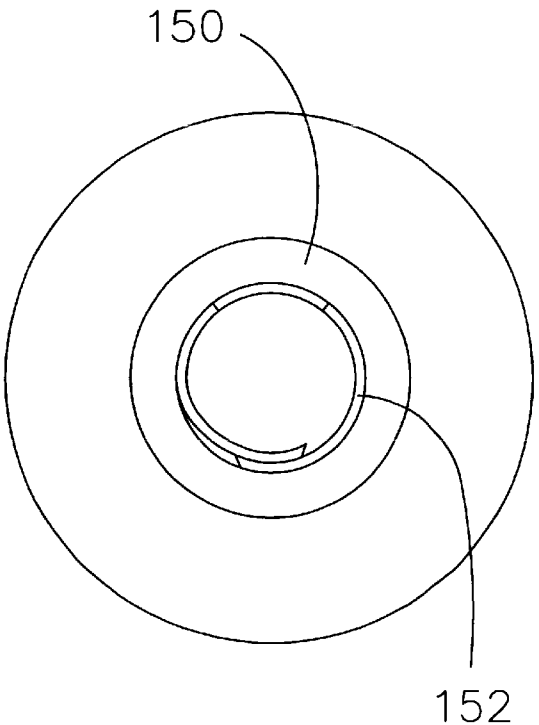
FIG. 24 is an end view of the arrangement of FIG. 23.
Figure 23:
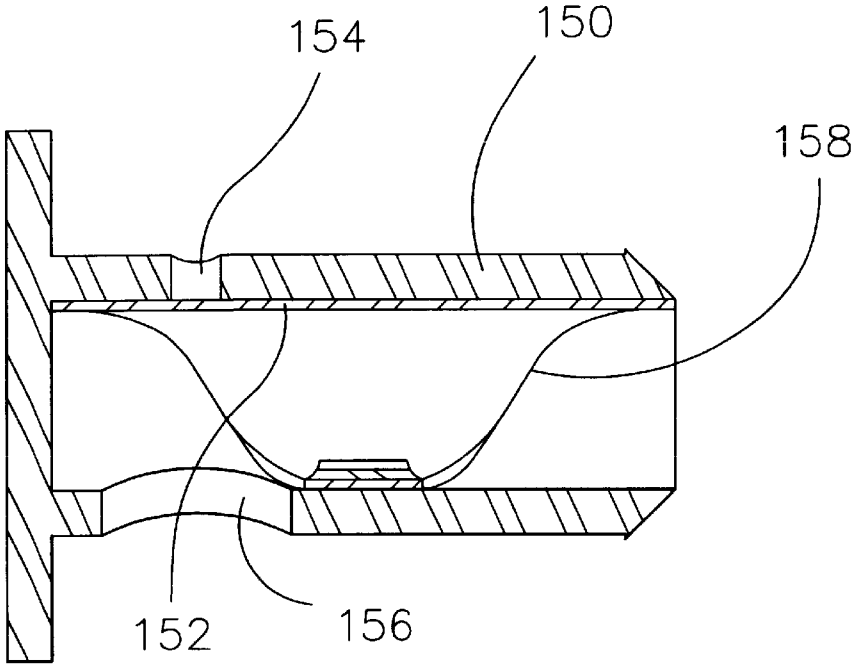
FIG. 23 is a cross-sectional view showing the sheet of FIGS. 21, 22 positioned in a dispenser member.

FIGS. 21–24 disclose an embodiment of the invention wherein a dispenser member 150 has positioned therein a valve member 152 which is constructed of thin sheet material which may be relatively rigid or flexible. For example, the material may be rigid plastic, Mylar polyester film, metal foil, rubber, silicone, krayton or polyethylene. No ledges are formed on the dispenser member 150. The sheet material from which the valve member 152 is formed may be generally circular or elliptical or another predetermined shape such as a parallelogram. FIG. 22 shows a representative shape when the sheet is flat and FIG. 21 shows the valve member formed after the sheet has been rolled and forms overlapping ends between the openings of the valve member.

The tubular shaped valve member is inserted into the dispenser member with the continuous side of the rolled sheet placed at the fluid ingress opening 154 of the dispenser member. The overlapping edges or ends of the rolled sheet are placed adjacent to the fluid egress opening 156 of the dispenser member.

When the rolled sheet comprising the valve member conforms to the internal surface of the dispenser member, the ends adjacent to the fluid egress opening might overlap as shown, or if desired, not overlap. It is important that the continuous sheet of material covers the fluid ingress opening and that the fluid egress opening is unobstructed.

The angled shape of the sheet illustrated and the fact that the rolled sheet is inserted with the overlapping edges adjacent to the fluid egress opening result in formation of a valve member opening 158 at the end of the rolled sheet positioned over the fluid egress opening.

The outwardly pressing rolled sheet makes a leak-tight seal around the fluid ingress opening and the entire inner surface of the dispenser member.

In this embodiment, as the fluid exits the fluid egress opening, a vacuum develops inside the associated container (not shown). This results in a pressure drop from outside the fluid ingress opening to inside the container. The combination of the rolled sheet covering the ingress opening acts as a check valve to prevent the fluid inside the container from exiting the fluid ingress opening and only allows air or external fluid to enter when a vacuum exists within the container. The rolled sheet acts as a spring and will flex inwardly by making more overlap between the overlapping sheet edges that are adjacent to the fluid egress opening. If the sheet material is fabricated from a resilient material such as Mylar polyester film, metal foil, high density polyethylene, silicone, krayton or semi rigid natural rubber, the rolled sheet might also flex by deforming inward toward the center of the dispenser member. The thickness and rigidity of the sheet material determines the spring constant or "springiness" of the check valve structure that results when the sheet is rolled and inserted into the dispenser member. Thus, the sheet material can be made from a variety of predetermined materials and can be rigid, flexible or resilient. The stiffest sheet material would be a thick rigid material such as Mylar polyester film, metal foil, high density polyethylene and the sheet with a much softer spring characteristic would be a thin resilient material such as silicone, krayton or natural rubber.

The structure of the sheet material rolled into the housing covering the ingress hole can be utilized to make a stand alone check valve. The fluid in egress opening can be separate from the housing of the fluid ingress opening.

Figure 27:
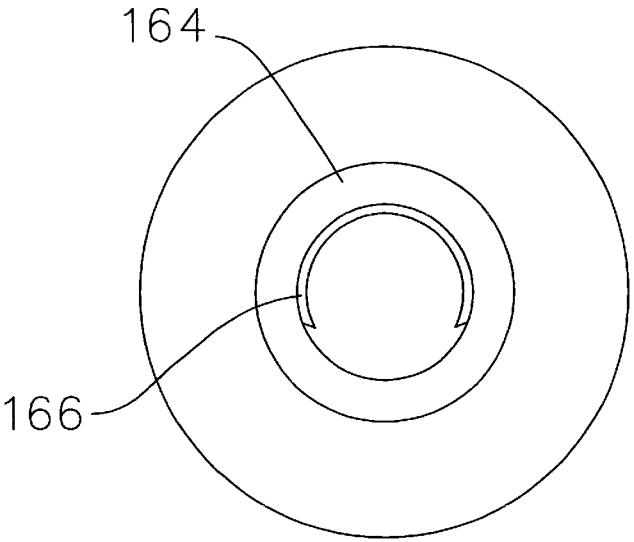
FIG. 27 is an end view of the arrangement of FIG. 26.
Figure 25:
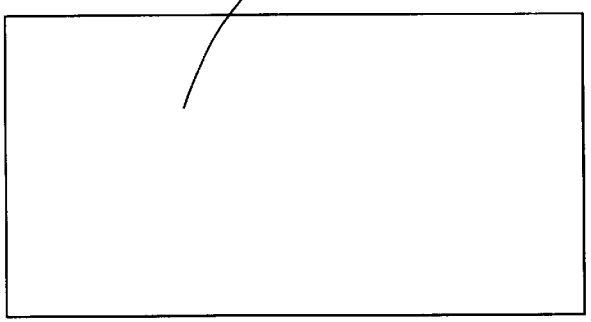
FIG. 25 is a plan view illustrating another form of sheet employable as a flexible valve member, the sheet shown in flat condition.
Figure 26:
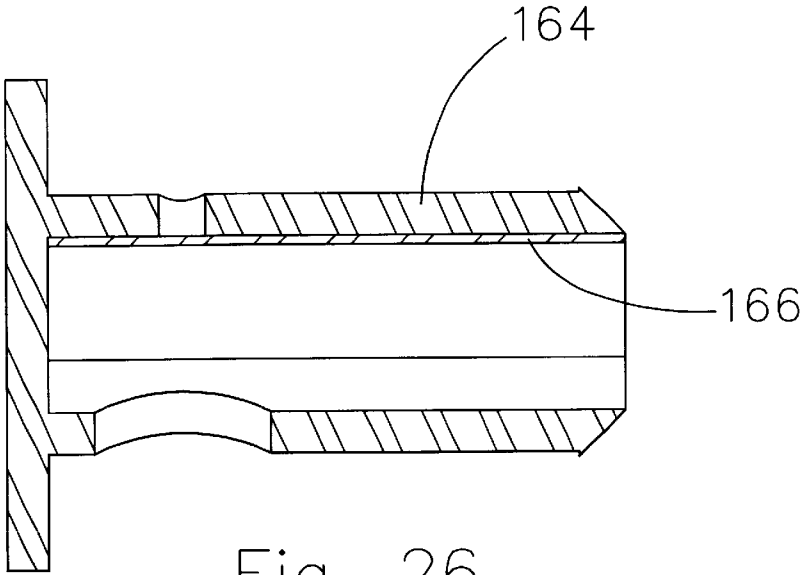
FIG. 26 is a cross-sectional side view showing the sheet of FIG. 25 bent and located in a dispenser member.
Figure 28C:
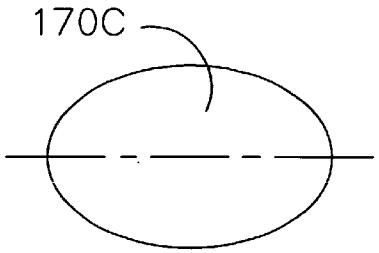
FIGS. 28A–28G are plan views of flat flexible sheets illustrating various configurations that can be employed when rolled as flexible valve members adapted for positioning in a longer dispenser member.
Figure 28G:
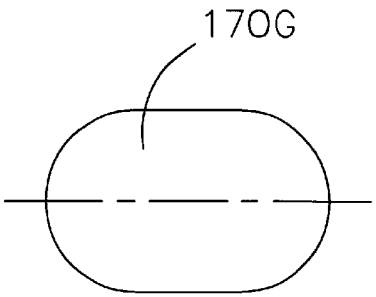
Figure 28B:
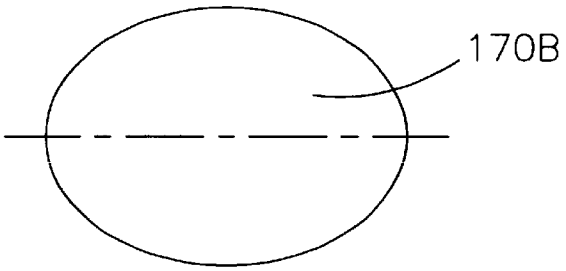
Figure 28D:
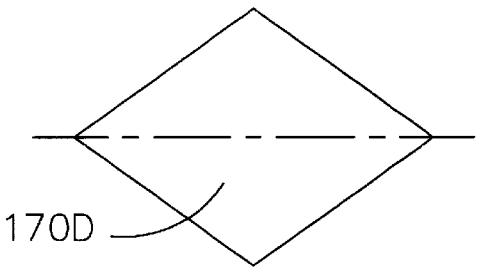
Figure 28F:
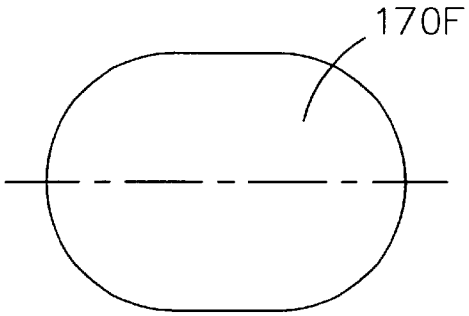
Figure 28A:
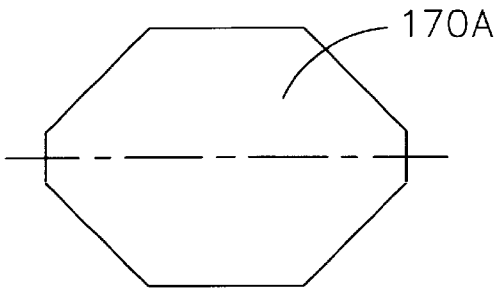
Figure 28E:
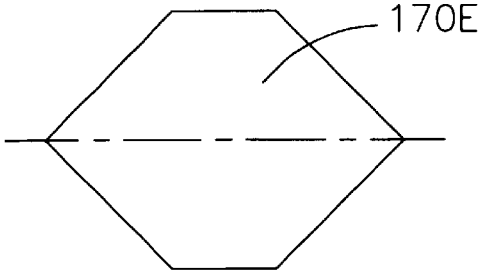
Figure 29A:
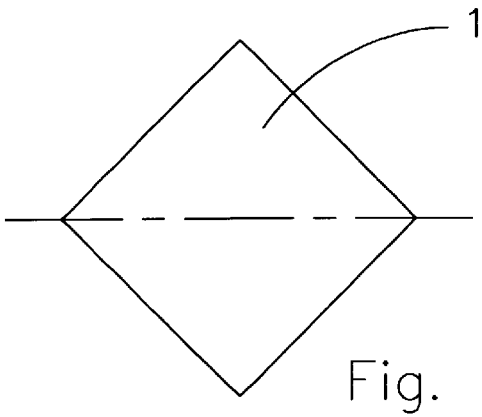
FIGS. 29A–29E are views similar to FIGS. 28A–28G but showing sheets employable in shorter dispenser members.
Figure 29B:
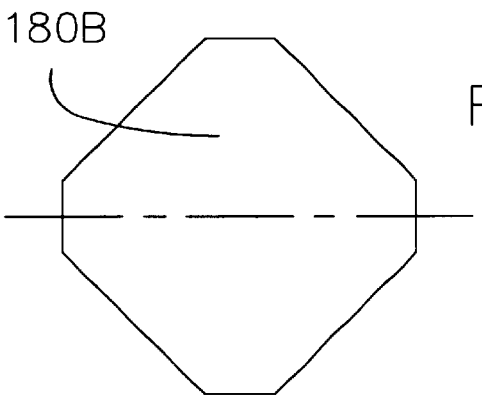
Figure 29C:
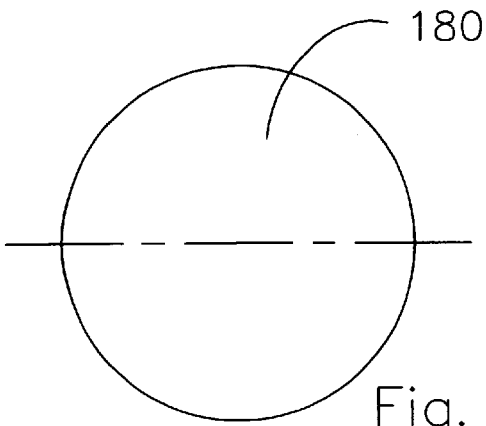
Figure 29D:
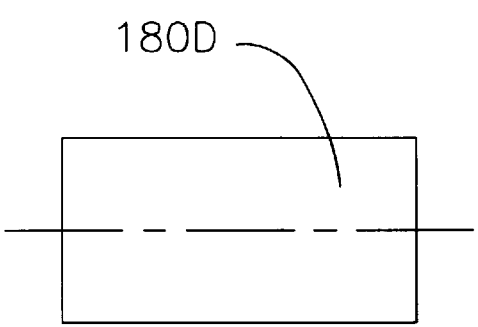
Figure 29E:
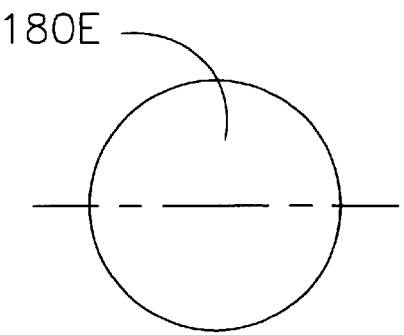

FIGS. 25–27 illustrate another form of the invention wherein a dispenser member 164 has disposed therein a rolled or arched flexible sheet 166 comprising the flexible valve member. In this arrangement, the flexible valve member covers the fluid ingress opening while leaving the fluid egress opening unobstructed.

FIGS. 28A through 28G illustrate, respectively, flattened sheets 170A–170G having different configurations and which can be formed into flexible valve members insertable into a relatively long dispenser member. The dash lines represent the axes for rolling these flexible sheets. The angled or curved ends fit over the fluid egress opening and the continuous curved sheet compresses at the location of the fluid ingress opening.

FIGS. 29A–29E illustrate sheets similar to those shown in FIGS. 28A–28G which can be inserted into shorter dispenser members.

The invention claimed is:

1. Fluid control and dispenser apparatus comprising, in combination:

a dispenser member, said dispenser member defining a dispenser member interior, a fluid inlet, a fluid ingress opening and a fluid egress opening, said fluid inlet, said fluid ingress opening and said fluid egress opening all being spaced from one another and communicating with said dispenser member interior; and a flexible valve member located in said dispenser member interior adjacent to said fluid ingress opening movable between a first position wherein said flexible valve member closes said fluid ingress opening and a second position wherein said flexible valve member is spaced from said fluid ingress opening, opens said fluid ingress opening and allows passage of fluid through said fluid ingress opening into said dispenser member interior, said flexible valve member being positioned between said fluid ingress opening and said fluid egress opening for directing fluid passing through said fluid ingress opening into said dispenser member interior away from said fluid egress opening and in the direction of said fluid inlet.

2. The apparatus according to claim 1 additionally comprising a support supporting said dispenser member, said support defining a support interior, a support inlet opening and a support outlet opening, said support inlet opening and said support outlet opening being spaced from one another and communicating with said support interior, said dispenser member being located within said support interior and slidably movable relative thereto between a dispensing position and a non-dispensing position, said flexible valve member extending from said fluid ingress opening to said support inlet opening.

3. The apparatus according to claim 1 wherein said flexible valve member is tubular along at least a portion of the length thereof.

4. The apparatus according to claim 1 wherein said flexible valve member is disposed over said fluid egress opening and defines a valve member opening communicating with said fluid egress opening.

5. The apparatus according to claim 1 wherein said dispenser member has a substantially cylindrical inner wall at least partially defining said dispenser member interior, an outer surface of said flexible valve member engaging said substantially cylindrical inner wall.

6. The apparatus according to claim 1 wherein said fluid ingress opening and said fluid outlet opening are in substantial alignment.

7. The apparatus according to claim 1 additionally comprising connector means for connecting said flexible valve member to said support member.

8. The apparatus according to claim 7 wherein said connector means comprises at least one elongated groove formed in either said support member or said flexible valve member and an elongated rib projecting from the other of said support member or said flexible valve member received by said elongated groove.

9. The apparatus according to claim 8 wherein a pair of elongated, spaced grooves are formed in either said support member or said flexible valve member and a pair of spaced, elongated ribs project from the other of said support member or said flexible valve member and form a fluid-tight seal between said support member and said flexible valve member at two spaced locations.

10. The apparatus according to claim 7 wherein said flexible valve member has opposed sides and wherein said connector means forms two spaced, fluid-tight seals between said dispenser member and said flexible valve member located at the opposed sides of said flexible valve member.

11. The apparatus according to claim 10 wherein said connector means comprises a pair of spaced grooves formed in said dispenser member and a pair of spaced, elongated ribs projecting from said flexible valve member positioned in said spaced grooves and forming said fluid-tight seals.

12. The apparatus according to claim 11 wherein the cross-sectional dimensions of said ribs exceed the cross-sectional dimensions of said spaced grooves whereby said ribs are compressed in said grooves.

13. The apparatus according to claim 1 wherein said dispenser member and said flexible valve member comprise structural elements of a spigot for connection to a container to dispense fluid from the container while introducing a replacement fluid into the container.

14. The apparatus according to claim 1 wherein said flexible valve member includes a fluid engagement surface spaced from said dispenser member and defining a fluid-flow passageway with said dispenser member for directing fluid received by said dispenser member interior from said fluid ingress opening to said fluid inlet.

15. The apparatus according to claim 1 additionally comprising an elongated member positioned between said dispenser member and said flexible valve member to exert pressure on a first portion of said flexible valve member at a location thereon spaced from said fluid ingress opening and urging a second portion of said flexible valve member toward said fluid ingress opening.

16. The apparatus according to claim 15 wherein said dispenser member defines a groove receiving said elongated member, with a portion of said elongated member projecting from said groove toward said flexible valve member and engaging said flexible valve member.

17. The apparatus according to claim 3 wherein at least one strengthening element is located within the tubular portion of said flexible valve member to resist collapse of said tubular portion.

18. The apparatus according to claim 1 wherein said flexible valve member comprises a resilient sleeve having an end connected to said dispenser member and a distal end.

19. The apparatus according to claim 18 wherein said distal end is flared radially outwardly.

20. The apparatus according to claim 19 wherein said dispenser member comprises a nozzle defining a groove and a plurality of fluid ingress openings located at said groove, the end of said resilient sleeve connected to said dispenser member having a circular detent positioned in said groove, said resilient sleeve being displaceable relative to said nozzle during movement of said flexible valve member between said first and second positions.

21. The apparatus according to claim 1 additionally comprising a closure positionable over said fluid ingress opening in engagement with said dispenser member.

22. Fluid control and dispenser apparatus comprising, in combination:

a dispenser member support;

a dispenser member defining a dispenser member interior and a fluid inlet, said dispenser member selectively movable relative to said dispenser member support between a non-dispensing position and a dispensing position and further defining a fluid ingress opening and a fluid egress opening, said fluid ingress and fluid egress opening being spaced from one another and from said fluid inlet;

a flexible valve member located in said dispenser member interior adjacent to said fluid ingress opening for sealing said fluid ingress opening to prevent passage of fluid therethrough into said dispenser member interior when said dispenser member is in said non-dispensing position and for opening said fluid ingress opening to allow passage of fluid therethrough when said dispenser member is in said dispensing position, said flexible valve member being positioned between said fluid ingress opening and said fluid egress opening for directing fluid passing through said fluid ingress opening away from said fluid egress opening toward said dispenser member support when said dispenser member is in said dispensing position.

23. Fluid control and dispenser apparatus comprising, in combination:

a container having a container interior;

a dispenser member connected to said container, said dispenser member defining a dispenser member interior, a fluid inlet in communication with said container interior, a fluid ingress opening and a fluid egress opening, said fluid inlet, said fluid ingress opening and said fluid egress opening all being spaced from one another and communicating with said dispenser member interior; and a flexible valve member located in said dispenser member interior adjacent to said fluid ingress opening movable between a first position wherein said flexible valve member closes said fluid ingress opening and a second position wherein said flexible valve member opens said fluid ingress opening allowing passage of fluid through said fluid ingress opening into said dispenser member interior, said flexible valve member being positioned between said fluid ingress opening and said fluid egress opening for directing fluid passing through said fluid ingress opening into said dispenser member interior away from said fluid egress opening and into said container interior through said dispenser member.

24. Fluid control and dispenser apparatus comprising, in combination:

a dispenser member, said dispenser member defining a dispenser member interior, a fluid inlet, a fluid ingress opening and a fluid egress opening, said fluid inlet, said fluid ingress opening and said fluid egress opening communicating with said dispenser member interior; and a generally tubular-shaped flexible valve member located in said dispenser member interior adjacent to said fluid ingress opening movable between a first position wherein said flexible valve member closes said fluid ingress opening and a second position wherein said flexible valve member is spaced from said fluid ingress opening, allowing passage of fluid through said fluid ingress opening into said dispenser member interior, said flexible valve member for directing fluid passing through said fluid ingress opening into said dispenser member interior away from said fluid egress opening and toward said fluid inlet.

25. Fluid control apparatus comprising, in combination:

a fluid flow path defining member at least partially defining a fluid flow path and a fluid inlet and fluid ingress opening communicating with said fluid flow path; and a flexible valve member operatively associated with said fluid flow path defining member and located adjacent to said fluid ingress opening, said flexible valve member movable between a first position wherein said flexible valve member closes said fluid ingress opening and a second position wherein said flexible valve member is spaced from said fluid ingress opening, opens said fluid ingress opening and allows passage of fluid through said fluid ingress opening into said fluid flow path.

26. The fluid control apparatus according to claim 25 wherein said fluid flow path defining member has a curved inner surface and wherein said flexible valve member comprises a curved sheet of material disposed in said fluid flow path having a portion thereof biased into engagement with said curved inner surface about said fluid ingress opening, said portion of said curved sheet of material being displaceable away from said curved inner surface about said fluid ingress opening when a predetermined pressure differential exists between said fluid flow path and the fluid entering said fluid inlet.

27. The fluid control apparatus according to claim 26 wherein said curved sheet of material is confined within said fluid flow path defining member and comprises a resilient sheet having a predetermined configuration differing from the normal unstressed configuration thereof when confined within said fluid flow path defining member, said resilient sheet being self-biased toward said fluid ingress opening and into direct contact with said fluid flow path defining member around said fluid ingress opening.

28. The fluid control apparatus according to claim 27 wherein said fluid flow path defining member has a tubular interior wall and wherein said resilient sheet has a tubular configuration, and is self-biased into direct engagement with said tubular interior wall.

* * * * *